US009471077B2

(12) United States Patent
Kobayashi

(10) Patent No.: US 9,471,077 B2
(45) Date of Patent: Oct. 18, 2016

(54) METHOD TO PRE-SET A COMPENSATION CAPACITOR VOLTAGE

(71) Applicant: Dialog Semiconductor (UK) Limited, Reading (GB)

(72) Inventor: Hidenori Kobayashi, Kawasaki (JP)

(73) Assignee: Dialog Semiconductor (UK) Limited, Reading (GB)

( * ) Notice: Subject to any disclaimer, the term of this patent is extended or adjusted under 35 U.S.C. 154(b) by 201 days.

(21) Appl. No.: 14/528,323

(22) Filed: Oct. 30, 2014

(65) Prior Publication Data

US 2016/0124447 A1 May 5, 2016

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC ..... H02M 3/156; H02M 3/158; G05F 1/56; G05F 1/562; G05F 1/565; G05F 1/575; G05F 1/59; G05F 1/595
USPC ..... 323/224–226, 242, 243, 246, 266, 323/268–274, 282, 284–286, 288
See application file for complete search history.

(56) References Cited

U.S. PATENT DOCUMENTS 5,929,692 A * 7/1999 Carsten ..... H02M 1/15 323/271
7,030,596 B1 4/2006 Salerno et al.
7,504,812 B2 3/2009 Riehl
8,395,367 B2 * 3/2013 Chien ..... H02M 3/1588 323/288
8,525,500 B1 * 9/2013 Martin ..... H02M 3/156 323/283
8,729,880 B2 5/2014 McCloy-Stevens et al.
2002/0135338 A1 * 9/2002 Hobrecht ..... H02J 1/102 323/272
2005/0140347 A1 * 6/2005 Chen ..... H02M 3/1584 323/282
2006/0255777 A1 * 11/2006 Koertzen ..... H02M 1/088 323/272
2007/0200633 A1 * 8/2007 Chen ..... H02M 3/156 331/1 A
2008/0246448 A1 * 10/2008 Chiu ..... H02M 3/156 323/234
2010/0001704 A1 * 1/2010 Williams ..... H02M 3/158 323/283
2010/0289424 A1 * 11/2010 Chang ..... H05B 33/0818 315/250

FOREIGN PATENT DOCUMENTS

CN 101753010 6/2010

* cited by examiner

*Primary Examiner* — Adolf Berhane
*Assistant Examiner* — Gary Nash
(74) *Attorney, Agent, or Firm* — Saile Ackerman LLC; Stephen B. Ackerman

(57) ABSTRACT

Compensation capacitor voltages of DC-to-DC converters are pre-set without switching to enable smooth transition from sleep mode to active mode. Appropriate compensation capacitor voltages are set regardless of the length of no-switching sleep period or input voltage change. Therefore the converter can always start with appropriate error amplifier and duty conditions, and avoid output voltage disturbance when the PWM control loop takes over in active mode the control of buck converter. The appropriate capacitor voltages are enabled by creating a local PWM feedback loop of a PWM control loop without enabling the output stage. This local PWM feedback loop works intermittently and always sets the appropriate voltage for the error amplifier and compensation capacitor.

15 Claims, 6 Drawing Sheets

METHOD TO PRE-SET A COMPENSATION CAPACITOR VOLTAGE

TECHNICAL FIELD

This disclosure relates generally to DC-to-DC converters relates specifically to a method to enable smooth transition from sleep mode to active mode.

BACKGROUND

Some buck converters have a light-load mode, known as PFM or gated oscillator mode. (In this invention disclosure, this mode is called as 'sleep'). In this sleep mode, the buck converter stops switching for a while until output voltage hits the defined lower threshold voltage. Especially in portable buck converter applications, most of circuits are disabled during this sleep mode to reduce the current consumption and to improve the efficiency at light load. Major challenge of this mode is transient response. When the output load changes from light load to heavy load, the converter has to change the operation mode from sleep to normal switching mode (PWM/Sync), because sleep mode cannot stably handle high output load. However, the error amplifier is usually disabled during sleep mode and it takes time to wake up. Especially, it is very difficult to set a proper compensation capacitor voltage in the error amplifier instantly. Improper voltage of compensation capacitor leads to significant output voltage disturbance when the PWM control loop takes over the buck converter control.

One solution of above problem is to hold the compensation capacitor voltage in the sleep mode, i.e. setting capacitor output as high impedance and let the capacitor keep the previous voltage in PWM mode. By this, when the converter goes back to PWM mode from sleep, the error amplifier can start-up in proper output voltage and smooth mode change can be achieved.

However, there are two critical issue of this. One is leak current. In practice in semiconductor circuits, even when a transistor is off, there are some leak currents. If the sleep mode continues for a long-time, then the capacitor voltage will be discharged by such a leak current and cannot hold appropriate voltage. Another issue is input voltage change. If the input voltage changes significantly during sleep mode, appropriate duty cycle, error amplifier voltage, and compensation capacitor voltage will be changed. In this case, even if the compensation capacitor keeps the previous voltage, that is not an appropriate voltage, so the output voltage disturbance will occur at mode change.

It is a challenge to designers of DC-to-DC converters as buck converters, boost converters, or buck/boost converters to overcome the disadvantages mentioned above.

SUMMARY

A principal object of the present disclosure is to achieve smooth transition between operation mode changes of DC-to-DC converters.

A further object of the present disclosure is to enable setting the appropriate compensation capacitor voltage regardless of the length of no-switching sleep period or input voltage change.

A further object of the present disclosure is to enable starting of PWM mode with appropriate error amplifier and duty cycle condition and avoiding output voltage disturbance when the PWM control loop takes over the control of DC-to-DC converters.

A further object of the present disclosure is to create a local PWM feedback loop of a PWM control loop without enabling buck output stage, wherein the local PWM feedback loop works intermittently and always sets the appropriate voltage for the error amplifier and compensation capacitor.

In accordance with the objects of this disclosure a voltage mode controlled buck converter enabled for smooth transition from sleep mode to active mode has been achieved. The buck converter disclosed firstly comprises: a main output stage comprising a high side switch and a low side switch both connected in series, wherein a driver stage is driving the main output stage, a coil, wherein a first terminal of the coil is connected to a node between the high side switch and the low side switch and a second terminal of the coil is connected to an output port of the buck converter configured to providing an output voltage of the buck converter, and a PWM control loop configured to control the buck converter during active mode, comprising an error amplifier configured to receiving an output voltage feedback of the buck converter and a reference voltage, a compensation capacitor connected between an output of the error amplifier and ground, a PWM comparator configured to compare the output of the error amplifier with an output of a ramp signal generator, and the driver stage driving the main output stage, wherein an output of the PWM comparator provides input to the driver stage. Furthermore the buck converter comprises: a local PWM feedback loop, capable of, when enabled intermittently during sleep mode, to set an appropriate compensation capacitor voltage regardless of the length of the sleep period, comprising a dummy output stage, comprising a high side switch and a low side switch both connected in series, wherein the dummy output stage is configured to be driven by the output of the PWM comparator, wherein an output of the driver stage is connected to a filter, and said filter, configured to provide at its output an emulated output voltage of the buck converter, wherein the output of the filter is connected, when enabled during sleep mode, to the error amplifier instead of the output voltage feedback the buck converter during active mode.

In accordance with the objects of this disclosure a current mode buck converter enabled for smooth transition from sleep mode to active mode has been achieved. The current mode controlled buck converter firstly comprises: a main output stage comprising a high side switch and a low side switch both connected in series, wherein a driver stage is driving the main output stage, a coil, wherein a first terminal of the coil is connected to a node between the high side switch and the low side switch and a second terminal of the coil is connected to an output port of the buck converter configured to providing an output voltage of the buck converter, and a PWM control loop configured to control the buck converter during active mode, comprising an error amplifier, configured to comparing a reference voltage and an output voltage of the buck converter, a PWM comparator configured to comparing an output of the error amplifier and an output of a summation node, a compensation capacitor connected between an output of the error amplifier and ground, wherein the output of the error amplifier is a first input to a PWM comparator and an output of a summation node is a second input to the PWM comparator, and the driver stage driving the main output stage, wherein an output of the PWM comparator provides input to the driver stage. Furthermore the buck converter comprises a slope compensation circuitry configured to suppress sub-harmonic oscillations and to reduce noise susceptibility, wherein an output of the slope compensation circuitry is a first input to the summation node, a current sensing means configured to sense an output current of the buck converter, wherein an output of the current sensing means is a second input to the summation node, and an inductor current emulation circuitry, configured to provide inductor current emulation information during sleep mode when no refreshing of the compensation capacitor is performed. Moreover the buck converter comprises a local PWM feedback loop, capable of, when enabled during sleep mode, to set an appropriate compensation capacitor voltage regardless of the length of the sleep period, the local feedback loop comprising: a dummy output stage, comprising a high side switch and a low side switch both connected in series, wherein the dummy output stage is configured to be driven by the output of the PWM comparator, wherein an output of the driver stage is connected to a filter, and said filter, configured to provide at its output an emulated output voltage of the buck converter, wherein the output of the filter is connected, when enabled during sleep mode, to the error amplifier instead of the output voltage feedback the buck converter during active mode.

In accordance with the objects of this disclosure a method to enable voltage mode buck converters for smooth transition from sleep mode to active mode has been achieved. The method disclosed comprises the steps of: (1) providing a voltage mode buck converter comprising an output stage, a compensation capacitor, an error amplifier, and a PWM control loop, (2) adding a local PWM feedback loop to the PWM control loop, wherein this local PWM feedback loop is configured to be enabled only in sleep mode to generate an emulated output voltage of the buck converter and wherein the main output stage is disabled during the sleep mode, (3) setting an appropriate compensation capacitor voltage and output voltage of the error amplifier during sleep mode by the local PWM feedback loop in order to enable the buck converter to start in active mode with appropriate voltages of the compensation capacitor and of the error amplifier output, and (4) refreshing intermittently the compensation capacitor voltage before a leak current discharges the compensation capacitor.

In accordance with the objects of this disclosure a method to enable current mode buck converters for smooth transition from sleep mode to active mode has been achieved. The method disclosed comprises firstly the steps of: (1) providing a current mode controlled buck converter comprising an output stage, a compensation capacitor, an error amplifier, a slope compensation circuitry, an inductor current emulation circuitry, a means to measure an inductor current, a PWM comparator receiving a first input from an error amplifier output and in an active mode of the buck converter a second input from a sum of an output of the inductor current measuring means and of an output of the slope compensation circuitry, and a PWM control loop, (2) adding a local PWM feedback loop to the PWM control loop, wherein this local PWM feedback loop is configured to be enabled only in sleep mode to generate an emulated output voltage of the buck converter and wherein the main output stage is disabled during the sleep mode, and (3) setting an appropriate compensation capacitor voltage and output voltage of the error amplifier during sleep mode by the local PWM feedback loop in order to enable the buck converter to start with appropriate voltages of the compensation capacitor and of the error amplifier output. Furthermore the method comprises (4) replacing during sleep mode of the buck converter in the second input of the PWM comparator the output of the inductor current measuring means by an output of the inductor current emulation circuitry, and (5) refreshing during sleep mode intermittently the compensation capacitor voltage before a leak current discharges the compensation capacitor.

BRIEF DESCRIPTION OF THE DRAWINGS

In the accompanying drawings forming a material part of this description, there is shown.

DETAILED DESCRIPTION

Disclosed are embodiments of methods and circuits to achieve smooth transition between operation mode changes of DC-to-DC converters.

In the following the methods and circuits disclosed are applied to buck converters but it should be understood that these methods and circuits can be applied also to other DC-to-DC converters as boost converters or buck/boost converters.

As disclosed in the following, appropriate compensation capacitor voltages are set regardless of the length of no-switching sleep period or input voltage change. Therefore the converter can always start with appropriate error amplifier and duty conditions, and avoid output voltage disturbance when a PWM control loop takes over the control of buck converter in active mode. The appropriate capacitor voltages are enabled by creating a local PWM feedback loop of a PWM control loop without enabling output stages. This local PWM feedback loop works intermittently and always sets the appropriate voltage for the error amplifier and compensation capacitor.

Figure 1:
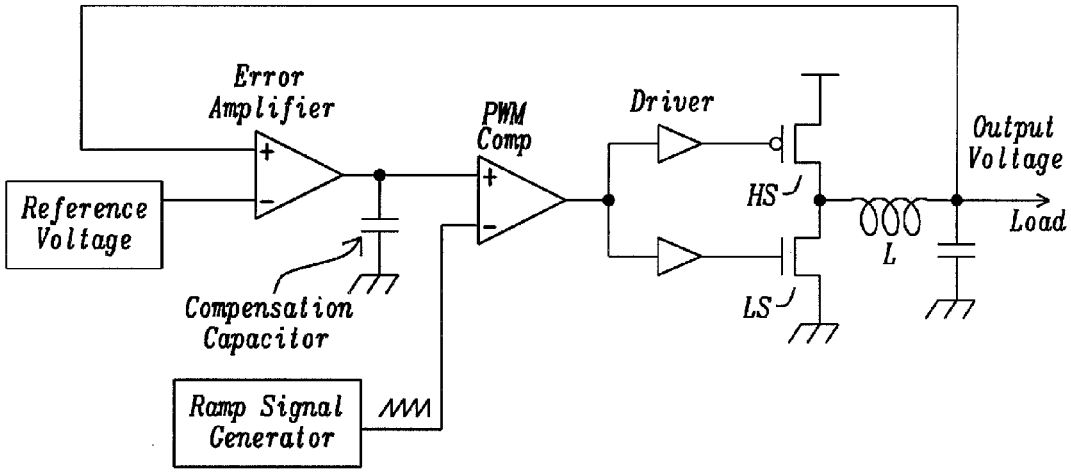
FIG. 1 shows a Voltage Mode Control Buck Converter.
Figure 2:
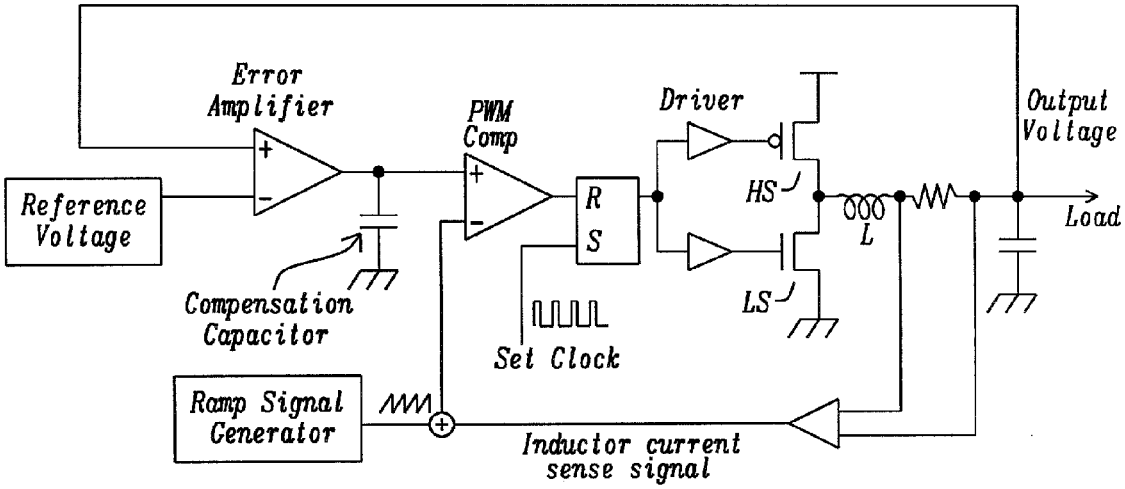
FIG. 2 shows a Current Mode Control Buck Converter.

FIG. 1 shows a voltage mode PWM control circuit and FIG. 2 shows a current mode PWM control circuit. In both circuits, there is an error amplifier and a compensation capacitor.

In voltage mode, the error amplifier compares the reference voltage and the output voltage of the converter. The error amplifier output voltage signal of the error amplifier is compared with triangular or saw-tooth ramp signals, and generates the appropriate pulses of PWM signals. If the output voltage of the converter is lower than the reference voltage, the error amplifier changes the output voltage to increase the duty ratio of the PWM signal, and the output voltage of the converter will increase accordingly.

In current mode control, the error amplifier compares the reference voltage and output voltage of the converter. The output signal of the error amplifier is compared with the sensed output current signal of the converter and in case the error amplifier output voltage is lower than the sensed inductor current signal, then the high side transistor HS of output stage is turned off, and the low side transistor is turned-on until the next cycle comes. In case the output voltage of the converter is lower than the reference voltage, the error amplifier changes its output voltage to increase the inductor current, and the output voltage of the converter will increase accordingly. The slope compensation circuit is usually required to-avoid sub-harmonic oscillation when the duty cycle is higher, and also to reduce the noise susceptibility.

Figure 3:
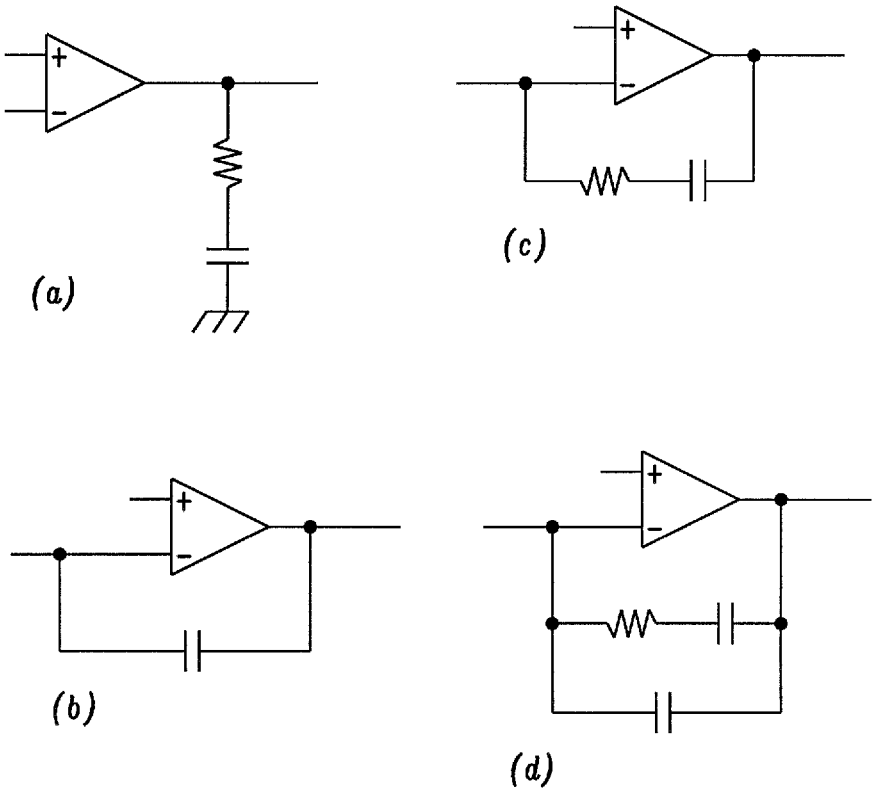
FIG. 3 illustrates several combinations of error amplifier & compensation networks.

FIG. 3 illustrates several combinations of error amplifier & compensation networks. There are many possibilities of error amplifier and compensation network configurations. FIG. 3 shows some possible configurations of error amplifier and compensation networks, but there are many other possibilities. However, it should be noted that any type of compensation networks works is applicable in this disclosure as long as the compensation capacitor has main compensation function.

Figure 4:
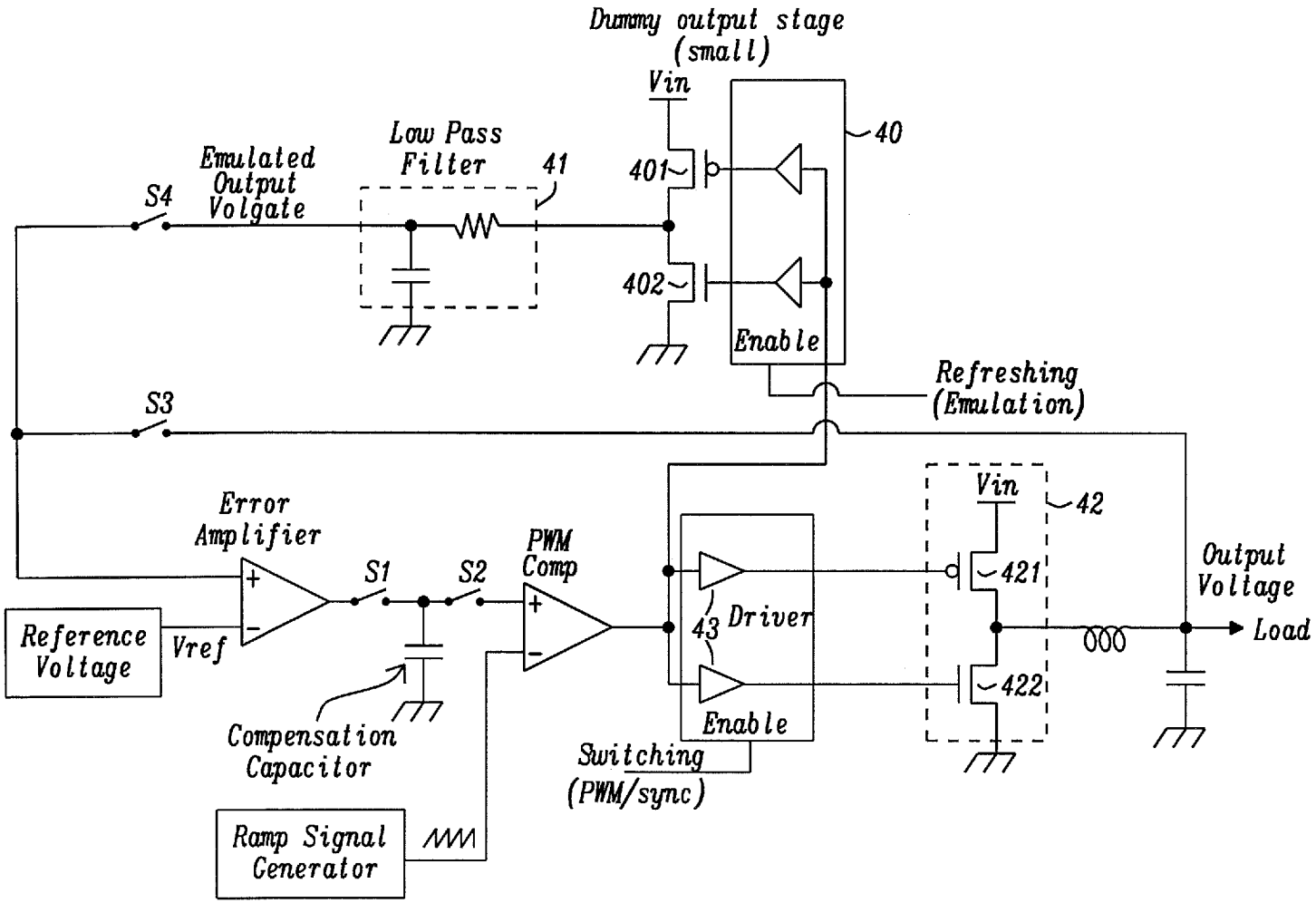
FIG. 4 shows a voltage mode control buck converter disclosed.

FIG. 4 shows a voltage mode control buck converter disclosed. A main output stage 42 comprises a high-side switch 421 and a low-side switch 422. There is an additional small dummy output stage 40 comprising high side switch 401 and low side switch 402. It should be noted that the main output stage 42 and the dummy output stage 40 can be independently enabled of each other and that the dummy output stage 40 is much smaller than the main output stage 42.

The input of the dummy output stage 40 is connected to the output of the PWM comparator, and the output of the dummy output stage 40 is connected to a low pass filter 41. Any type of low-pass filter is applicable, but most likely this will be $1^{st}$ order or $2^{nd}$ order RC-filter in practice. This output of the dummy output stage 40 is an emulated output voltage which is very close to the output voltage of the converter, because the output voltage Vout of buck converters can be roughly calculated by following equation:

$$Vout \sim = (PWM\ Duty) \times (Input\ Voltage).$$

The PWM control loop therefore still works as usual, even if we connect this emulated output voltage instead of actual output voltage to the error amplifier. In other words, we can set the appropriate error amplifier voltage and compensation capacitor voltage without enabling actual output stage. During sleep mode, the error amplifier is disabled, but the compensation capacitor is set as high impedance and hence, we can keep an appropriate error amplifier output voltage. If this local loop is intermittently activated during sleep mode, the compensation capacitor is always appropriately refreshed, regardless of any leak current or input voltage change, so if the output current (load current) suddenly increases, the PWM control loop can wake up with minimum delay and smoothly takes over the control.

Switch S3 is open during sleep mode and closed during active mode, Switch S4 is open during active mode and closed for refreshing the compensation capacitor during sleep mode. The refreshing phase of the compensation capacitor will be outlined later in the document.

In summary, in active mode the main output stage, the error amplifier, the PWM comparator, the ramp signal generator, and the driver stage of the main output stage are enabled and the dummy output stage is disabled.

In sleep mode, without refreshing the compensation capacitor, the main output stage, the dummy output stage, the error amplifier, the PWM comparator and the driver stage are disabled.

In sleep mode, during refreshing the compensation capacitor, the main output stage and the driver stage are disabled and the dummy output stage, the error amplifier and the PWM comparator are enabled.

The table below shows the status of switches S1-S4 dependent on the operation modes:

| | S1 | S2 | S3 | S4 | |
|---|---|---|---|---|---|
| Active/switching mode | closed | closed | closed | open | Normal PWM operation |
| Sleep mode - no refreshing comp. capacitor | open | open | irrel-evant | irrel-evant | Holding compensation capacitor value |
| Sleep mode-refreshing comp. capacitor | closed | closed | open | closed | Refreshing compensation capacitor value |

Figure 5:
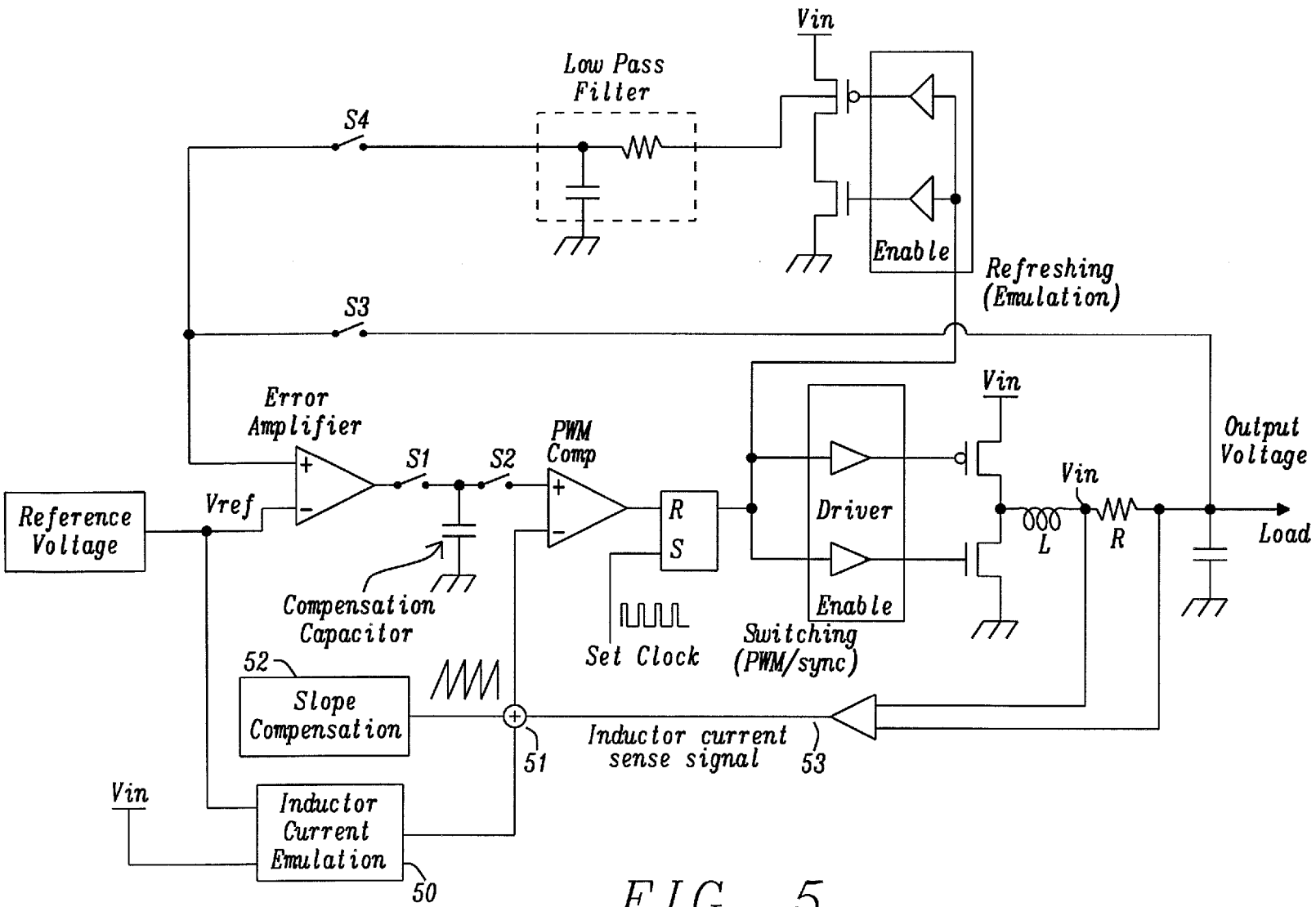
FIG. 5 shows a current mode control buck converter disclosed.

FIG. 5 shows a current mode control buck converter disclosed. The only difference to the voltage mode buck converter shown in FIG. 4 is that current mode control requires emulated inductor current information. Emulated inductor current information can be generated based on reference voltage (target output) and input voltage by following equation $$di/dt = Lout(Vin - Vout),$$

wherein $L_{out}$ is the inductance of the coil L of the buck converter operating in current mode, Vin is the input voltage of the buck converter as shown in FIGS. 4 and 5, and Vout is the output voltage of the buck converter.

The output signal of the Inductor Current Emulation block 50 corresponds to di/dt as outlined in the equation above. The output of the summation point 51 (input of PWM comparator) in active mode is the sum of the "inductor current sense signal" 53 and the output of slope compensation 52, and in sleep mode the sum of the output of the inductor current emulation block 50 and the output of slope compensation 52, i.e. the current emulation replaces in sleep mode, including the compensation capacitor refreshing phase, the inductor current sense signal, subsequently the slope compensation block is enabled during sleep mode.

The inductor current emulation block 50 creates an "emulated" current sense signal receiving input from the reference voltage Vref and the input voltage of the buck converter Vin. The inductor current emulation block 50 may be disabled during active mode of the buck converter.

The circuit function 51 to get the emulated inductor current information can be integrated into slope compensation 50, because slope compensation generates a similar signal. Exactly the same way as in voltage mode, with emulated output voltage or emulated inductor current, we can implement and enable a local PWM loop without enabling the actual output stage. Thus, we can refresh the compensation capacitor during sleep, and smooth PWM loop start-up can be achieved.

As described above, this local PWM loop can work almost same way as actual PWM control loop operation but without output stage switching. This means, the error amplifier and output capacitor can be set to appropriate voltage by this local control loop.

in active mode the main output stage, the error amplifier, the PWM comparator, the slope compensation, and the driver stage of the main output stage are enabled, and the dummy output stage and the inductor current emulation circuitry are disabled, in sleep mode, without refreshing the compensation capacitor, the main output stage, the dummy output stage, the error amplifier, the PWM comparator, the slope compensation, the inductor current emulation circuitry and the driver stage are disabled, and in sleep mode, during refreshing the compensation capacitor, the main output stage and the driver stage are disabled and the dummy output stage, the error amplifier, the slope compensation, the inductor current emulation circuitry, and the PWM comparator are enabled.

Therefore, if we enable this local PWM loop in no-switching sleep state, we can set the appropriate voltage of the error amplifier and compensation capacitor. After enabling this local loop and setting appropriate voltage, we can then disable the error amplifier and make the compensation capacitor node to a 'high-impedance' node. Then the compensation capacitor and error amplifier output voltage can be kept for a while. Before a leak current discharges the compensation capacitor, the system needs to enable this local PWM feedback loop again, and refresh the compensation capacitor voltage.

Even when input voltage is changed, as long as this local PWM control loop is enabled intermittently, the error amplifier output voltage and compensation capacitor are always set to appropriate voltage, and the buck converter can always start with appropriate voltage.

Figure 6:
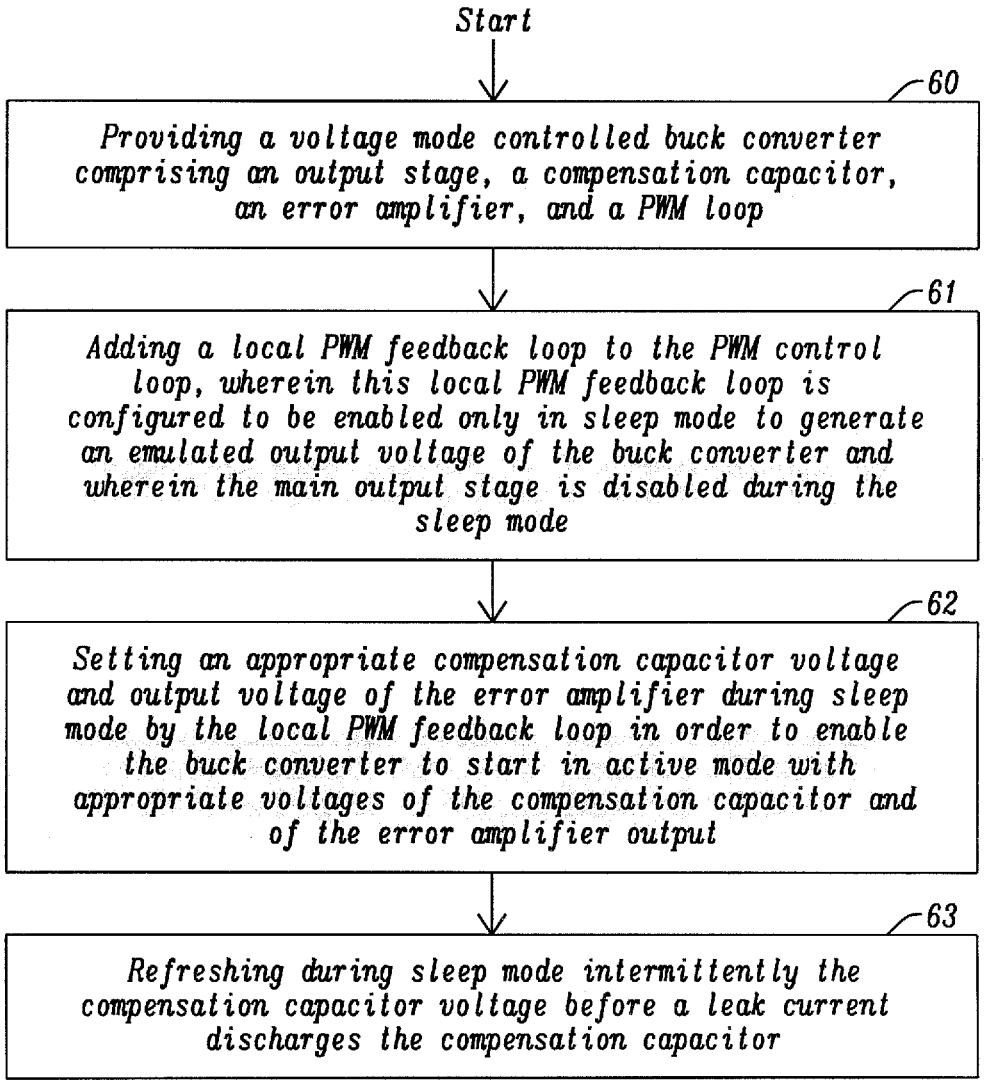
FIG. 6 depicts a flowchart of a method to enable smooth transition of voltage mode control buck converters from sleep mode to active mode.

FIG. 6 shows a flowchart of a method to enable smooth transition of voltage mode controlled buck converters from sleep mode to active mode. A first step 60 depicts provision of a voltage mode controlled buck converter comprising an output stage, a compensation capacitor, an error amplifier, and a PWM control loop. The next step 61 shows adding a local PWM feedback loop to the PWM control loop, wherein this local PWM feedback loop is configured to be enabled only in sleep mode to generate an emulated output voltage of the buck converter and wherein the main output stage is disabled during the sleep mode. Step 62 describes setting an appropriate compensation capacitor voltage and output voltage of the error amplifier during sleep mode by the local PWM feedback loop in order to enable the buck converter to start in active mode with appropriate voltages of the compensation capacitor and of the error amplifier output and the last step 63 illustrates refreshing during sleep mode intermittently the compensation capacitor voltage before a leak current discharges the compensation capacitor. The time interval between refreshing the compensation capacitor depends on the size of the compensation capacitor and the value of the leak current, typically the time interval may range between 1 msec and 10 msec.

Figure 7:
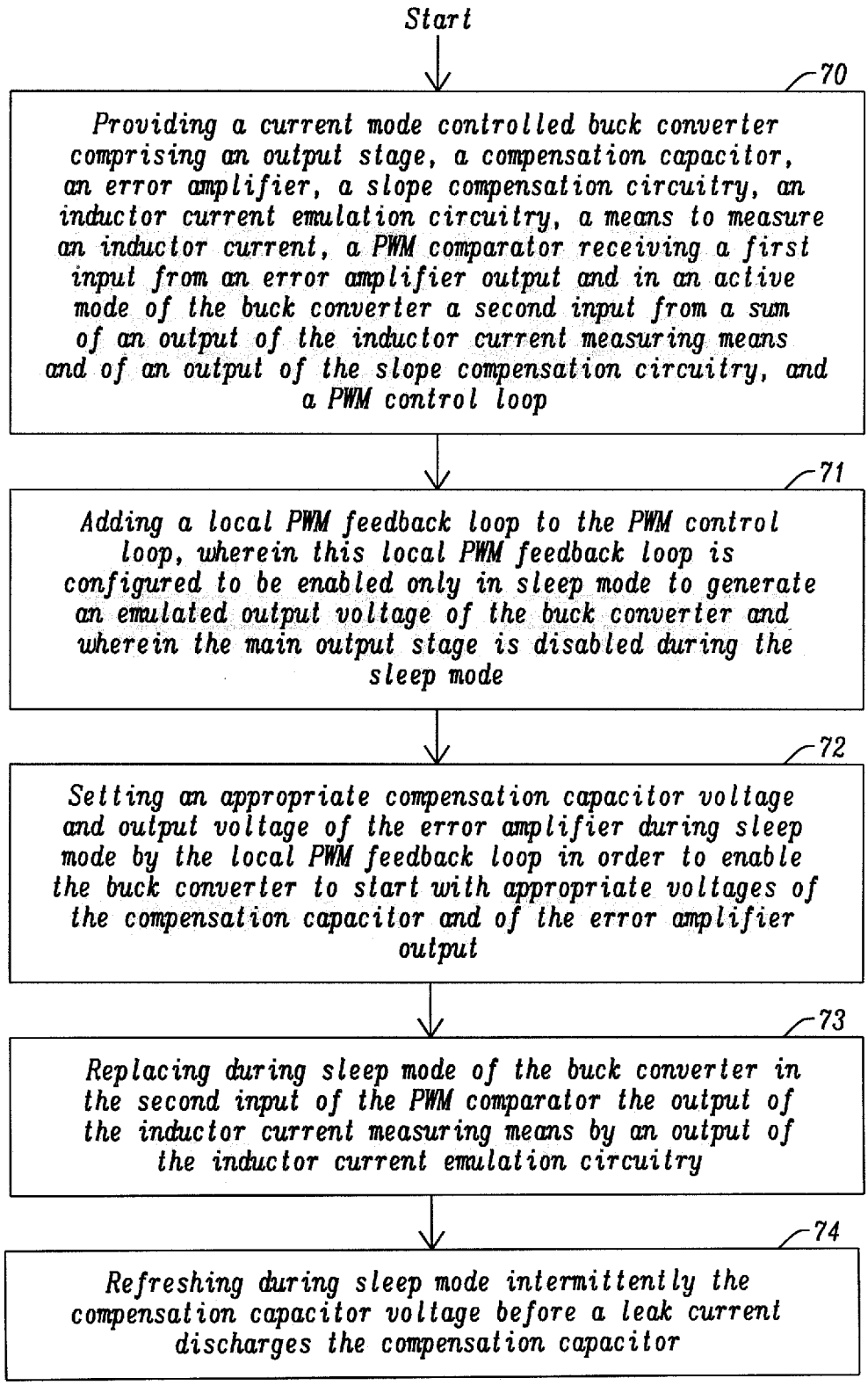
FIG. 7 depicts a flowchart of a method to enable smooth transition of current mode control buck converters from sleep mode to active mode.

FIG. 7 shows a flowchart of a method to enable smooth transition of current mode buck converters from sleep mode to active mode. A first step 70 depicts provision of a current mode controlled buck converter comprising an output stage, a compensation capacitor, an error amplifier, a slope compensation circuitry, an inductor current emulation circuitry, a means to measure an inductor current, a PWM comparator receiving a first input from an error amplifier output and in an active mode of the buck converter a second input from a sum of an output of the inductor current measuring means and of an output of the slope compensation circuitry, and a PWM control loop. Step 71 describes adding a local PWM feedback loop to the PWM control loop, wherein this local PWM feedback loop is configured to be enabled only in sleep mode to generate an emulated output voltage of the buck converter and wherein the main output stage is disabled during the sleep mode. Step 72 illustrates an appropriate compensation capacitor voltage and output voltage of the error amplifier during sleep mode by the local PWM feedback loop in order to enable the buck converter to start with appropriate voltages of the compensation capacitor and of the error amplifier output. Step 73 shows replacing during sleep mode of the buck converter in the second input of the PWM comparator the output of the inductor current measuring means by an output of the inductor current emulation circuitry, and the last step 74 illustrates refreshing during sleep mode intermittently the compensation capacitor voltage before a leak current discharges the compensation capacitor.

While the disclosure has been particularly shown and described with reference to the preferred embodiments thereof, it will be understood by those skilled in the art that various changes in form and details may be made without departing from the spirit and scope of the disclosure.

What is claimed is:

1. A voltage mode controlled buck converter enabled for smooth transition from sleep mode to active mode, comprising:

a main output stage comprising a high side switch and a low side switch both connected in series, wherein a driver stage is driving the main output stage;

a coil, wherein a first terminal of the coil is connected to a node between the high side switch and the low side switch and a second terminal of the coil is connected to an output port of the buck converter configured to providing an output voltage of the buck converter;

a PWM control loop configured to control the buck converter during active mode, comprising an error amplifier configured to receiving an output voltage feedback of the buck converter and a reference voltage, a compensation capacitor connected between an output of the error amplifier and ground, a PWM comparator configured to compare the output of the error amplifier with an output of a ramp signal generator, and the driver stage driving the main output stage, wherein an output of the PWM comparator provides input to the driver stage; and a local PWM feedback loop, capable of, when enabled intermittently during sleep mode, to set an appropriate compensation capacitor voltage regardless of the length of the sleep period, comprises:

a dummy output stage, comprising a high side switch and a low side switch both connected in series, wherein the dummy output stage is configured to be driven by the output of the PWM comparator, wherein an output of the dummy output stage is connected to a filter; and said filter, configured to provide at its output an emulated output voltage of the buck converter, wherein the output of the filter is connected, when enabled during sleep mode, to the error amplifier instead of the output voltage feedback the buck converter during active mode.

2. The buck converter of claim 1, wherein the buck converter is capable of refreshing the compensation capacitor intermittently during sleep mode before a leak current discharges the compensation capacitor.

3. The buck converter of claim 2, wherein in active mode the main output stage, the error amplifier, the PWM comparator, the ramp signal generator, and the driver stage of the main output stage are enabled and the dummy output stage is disabled, in sleep mode, without refreshing the compensation capacitor, the main output stage, the dummy output stage, the error amplifier, the PWM comparator and the driver stage are disabled, and in sleep mode, during refreshing the compensation capacitor, the main output stage and the driver stage are disabled and the dummy output stage, the error amplifier and the PWM comparator are enabled.

4. The buck converter of claim 2, wherein the buck converter further comprises:

a first switch, connected between an output of the error amplifier and a first terminal of the compensation capacitor, configured to be closed during active mode and during refreshing the compensation capacitor in sleep mode of the buck converter, and to be open during sleep mode when no refreshing is performed;

a second switch, connected between the first terminal of the compensation capacitor and a positive input of the PWM comparator, configured to be closed during active mode and during refreshing the compensation capacitor in sleep mode of the buck converter, and to be open during sleep mode when no refreshing is performed;

a third switch, wherein a first terminal of the switch is connected to the output port of the buck converter and a second terminal of the switch is connected to a positive input of the error amplifier, configured to be closed during active mode and to be open in sleep mode during the refreshing of the compensation capacitor; and a fourth switch, wherein a first terminal of the switch is connected to the output of the filter and a second terminal of the switch is connected to a positive input of the error amplifier, configured to be open during active mode and to be closed in sleep mode during the refreshing of the compensation capacitor.

5. A current mode buck converter enabled for smooth transition from sleep mode to active mode, comprising:

a main output stage comprising a high side switch and a low side switch both connected in series, wherein a driver stage is driving the main output stage;

a coil, wherein a first terminal of the coil is connected to a node between the high side switch and the low side switch and a second terminal of the coil is connected to an output port of the buck converter configured to providing an output voltage of the buck converter;

a PWM control loop configured to control the buck converter during active mode, comprising an error amplifier, configured to comparing a reference voltage and an output voltage of the buck converter, a PWM comparator configured to comparing an output of the error amplifier and an output of a summation node, a compensation capacitor connected between an output of the error amplifier and ground, wherein the output of the error amplifier is a first input to a PWM comparator and an output of a summation node is a second input to the PWM comparator, and the driver stage driving the main output stage, wherein an output of the PWM comparator provides input to the driver stage;

a slope compensation circuitry configured to suppress sub-harmonic oscillations and to reduce noise susceptibility, wherein an output of the slope compensation circuitry is a first input to the summation node;

a current sensing means configured to sense an output current of the buck converter, wherein an output of the current sensing means is a second input to the summation node;

an inductor current emulation circuitry, configured to provide inductor current emulation information during sleep mode when no refreshing of the compensation capacitor is performed;

a local PWM feedback loop, capable of, when enabled during sleep mode, to set an appropriate compensation capacitor voltage regardless of the length of the sleep period, comprises:

a dummy output stage, comprising a high side switch and a low side switch both connected in series, wherein the dummy output stage is configured to be driven by the output of the PWM comparator, wherein an output of the dummy output stage is connected to a filter; and said filter, configured to provide at its output an emulated output voltage of the buck converter, wherein the output of the filter is connected, when enabled during sleep mode, to the error amplifier instead of the output voltage feedback the buck converter during active mode.

6. The buck converter of claim 5, wherein the dummy output stage is smaller than the main output stage.

7. The buck converter of claim 5, wherein the buck converter is capable of refreshing the compensation capacitor intermittently during sleep mode before a leak current discharges the compensation capacitor.

8. The buck converter of claim 7, wherein in active mode the main output stage, the error amplifier, the PWM comparator, the slope compensation, and the driver stage of the main output stage are enabled, and the dummy output stage and the inductor current emulation circuitry are disabled, in sleep mode, without refreshing the compensation capacitor, the main output stage, the dummy output stage, the error amplifier, the PWM comparator, the slope compensation, the inductor current emulation circuitry and the driver stage are disabled, and in sleep mode, during refreshing the compensation capacitor, the main output stage and the driver stage are disabled and the dummy output stage, the error amplifier, the slope compensation, the inductor current emulation circuitry, and the PWM comparator are enabled.

9. The buck converter of claim 7, wherein the buck converter further comprises:

a first switch, connected between an output of the error amplifier and a first terminal of the compensation capacitor, configured to be closed during active mode and during refreshing the compensation capacitor in sleep mode of the buck converter, and to be open during sleep mode when no refreshing is performed;

a second switch, connected between the first terminal of the compensation capacitor and a positive input of the PWM comparator, configured to be closed during active mode and during refreshing the compensation capacitor in sleep mode of the buck converter, and to be open during sleep mode when no refreshing is performed;

a third switch, wherein a first terminal of the switch is connected to the output port of the buck converter and a second terminal of the switch is connected to a positive input of the error amplifier, configured to be closed during active mode and to be open in sleep mode during the refreshing of the compensation capacitor; and a fourth switch, wherein a first terminal of the switch is connected to the output of the filter and a second terminal of the switch is connected to a positive input of the error amplifier, configured to be open during active mode and to be closed in sleep mode during the refreshing of the compensation capacitor.

10. A method to enable voltage mode buck converters for smooth transition from sleep mode to active mode, comprising the steps of:

(1) providing a voltage mode buck converter comprising an output stage, a compensation capacitor, an error amplifier, and a PWM control loop;

(2) adding a local PWM feedback loop to the PWM control loop, wherein this local PWM feedback loop is configured to be enabled only in sleep mode to generate an emulated output voltage of the buck converter and wherein the main output stage is disabled during the sleep mode;

(3) setting an appropriate compensation capacitor voltage and output voltage of the error amplifier during sleep mode by the local PWM feedback loop in order to enable the buck converter to start in active mode with appropriate voltages of the compensation capacitor and of the error amplifier output; and (4) refreshing intermittently the compensation capacitor voltage before a leak current discharges the compensation capacitor.

11. The method of claim 10 wherein the method is applicable for PFM and PWM modulation.

12. The method of claim 10 wherein the method is also applicable to boost converters or buck/boost converters against shorts between a boosted voltage and supply voltage.

13. A method to enable current mode buck converters for smooth transition from sleep mode to active mode, comprising the steps of:

(1) providing a current mode controlled buck converter comprising an output stage, a compensation capacitor, an error amplifier, a slope compensation circuitry, an inductor current emulation circuitry, a means to measure an inductor current, a PWM comparator receiving a first input from an error amplifier output and in an active mode of the buck converter a second input from a sum of an output of the inductor current measuring means and of an output of the slope compensation circuitry, and a PWM control loop;

(2) adding a local PWM feedback loop to the PWM control loop, wherein this local PWM feedback loop is configured to be enabled only in sleep mode to generate an emulated output voltage of the buck converter and wherein the main output stage is disabled during the sleep mode;

(3) setting an appropriate compensation capacitor voltage and output voltage of the error amplifier during sleep mode by the local PWM feedback loop in order to enable the buck converter to start with appropriate voltages of the compensation capacitor and of the error amplifier output;

(4) replacing during sleep mode of the buck converter in the second input of the PWM comparator the output of the inductor current measuring means by an output of the inductor current emulation circuitry; and (5) refreshing during sleep mode intermittently the compensation capacitor voltage before a leak current discharges the compensation capacitor.

14. The method of claim 13 wherein the method is applicable for PFM and PWM modulation.

15. The method of claim 13 wherein the method is also applicable to boost converters or buck/boost converters against shorts between a boosted voltage and supply voltage.

* * * * *